United States Patent [19]

Prescott et al.

[11] 4,451,302

[45] May 29, 1984

[54] ALUMINUM NITRIDING BY LASER

[75] Inventors: Ernest Prescott, Arnold; William C. Cochran, Fox Chapel Borough, both of Pa.

[73] Assignee: Aluminum Company of America, Pittsburgh, Pa.

[21] Appl. No.: 412,113

[22] Filed: Aug. 27, 1982

[51] Int. Cl.[3] ..... C22F 1/04

[52] U.S. Cl. ..... 148/13.1; 148/16.6; 148/437; 148/39

[58] Field of Search ..... 148/13.1, 1, 13, 39, 148/4, 14, 16.6, 20.3, 440, 437, 31.5, 32; 219/121 LE, 121 L, 121 LF, 121 LM

[56] References Cited

U.S. PATENT DOCUMENTS

| | | | |
|---|---|---|---|
| 3,944,443 | 3/1976 | Jones | 148/16.5 |
| 4,015,100 | 3/1977 | Gnanamuthu et al. | 219/121 LF |
| 4,157,923 | 6/1979 | Yen et al. | 148/4 |
| 4,244,751 | 1/1981 | Hioki et al. | 148/1 |
| 4,313,771 | 2/1982 | Lorenzo et al. | 148/14 |

OTHER PUBLICATIONS

Uglov, "Lasers in Metallurgy and Technology of Inorganic Materials", *Sov. Journ. Quant. Electron,* vol. 4, No. 5, Nov. 1974, pp. 565–573.

Wakefield, "Laser Right on the Beam for Heat Treating Duty", *Iron Age,* Feb. 10, 1975, pp. 45–47.

Metals Handbook, 9th Edition, vol. 2, p. 45, Nov. 1979, American Soc. for Metals.

Kudela et al., "Study of Nitridation Process of Aluminum–Magnesium Alloys", Kovove Materialy 6.17–Bratislava, (1979).

*J. Chem. Phys.* 75(4), Aug. 15, 1981, Taylor et al., "Reaction of $N_2$+ Beams with Aluminum Surfaces".

*J. Appl. Phys.* 52(9), Sep. 1981, Lieske et al., "Formation of Al–Nitride Films at Room Temperature by Nitrogen Ion Implantation Into Aluminum".

*Applications of Lasers in Materials Processing,* American Society for Metals, (1979), p. 199.

*Primary Examiner*—L. Dewayne Rutledge
*Assistant Examiner*—S. Kastler
*Attorney, Agent, or Firm*—Douglas G. Glantz

[57] ABSTRACT

Nitriding a workpiece of aluminum or aluminum alloy by laser treatment in an atmosphere rich in nitrogen is disclosed. Laser treatment is applied for a period of less than one second at a laser power density of at least $0.1 \times 10^6$ W/cm$^2$ to form a hard workpiece surface layer comprising aluminum nitride. A workpiece surface pretreatment, prior to exposure to the laser beam, forms a smutty surface layer having a low content of impurities. A preferred embodiment includes utilizing an aluminum alloy containing an amount of at least 5 weight percent silicon and less than 2.1 weight percent magnesium.

11 Claims, No Drawings

ALUMINUM NITRIDING BY LASER

BACKGROUND OF THE INVENTION

1. Technical Field

This invention relates to a method for nitriding aluminum or aluminum alloy.

2. Background of Prior Art

The nitriding of special alloy steels is a well-known process which is used commercially to increase surface hardness and wear resistance. Nitrogen is reacted with the steels to form precipitates of nitrides and carbonitrides of iron, aluminum, chromium, molybdenum, and other elements present in the nitriding steels. One method involves the immersion of the steel in molten cyanides for an hour at about 600° C. Another method involves the gas nitriding of steel parts by annealing in ammonia at 500° C. for up to 100 hours. A more recent commercial process called "Ionitriding" involves forming activated nitrogen ions in a glow discharge to bombard the surface of iron and titanium alloys and provide the nitriding reaction. Ionitriding typically is conducted in a vacuum vessel at 500–1000 volts for 10 to 12 hours at substrate temperatures as low as 350° C.

Aluminum nitride, AlN, is a well-known metallurgical compound which conventionally has been produced by heating aluminum powder or turnings in an atmosphere of nitrogen at temperature reportedly as low as 400° C. Aluminum nitride has good chemical and heat stability, and its use has been proposed for nozzles, thermocouple tubes, crucibles, and the like. Because of the high hardness and good chemical stability, aluminum nitride in the surfaces of aluminum alloys will increase hardness and resistance to wear. Although aluminum nitride is said to hydrolyze slowly in contact with moisture, it could be very stable when buried in a metal matrix as in a compact, sintered part.

However, as pointed out in the article by Kudela et al, "Study of Nitridation Process of Aluminum-Magnesium Alloys," Kovove Materialy 6.17-Bratislava (1979), aluminum nitride can be formed only to a slight extent in compact aluminum. Aluminum in compact form when subjected to relatively high temperatures and high partial pressures of nitrogen, e.g., 1200°–1400° C. with 99.995% purity nitrogen at 1–5 MPa of nitrogen pressure, over 60 and 120 minutes attains a maximum nitrogen content of 273 ppm. In such a process, aluminum nitride particles are not observed in the microstructure. The Kudela et al article discloses that magnesium present in aluminum alloy can have a significant effect in enhancing aluminum nitride formation in metal volume. Magnesium is characterized and described as a catalyst for compact aluminum nitridation. The article reports that increasing magnesium in an Al—Mg alloy, e.g., increasing magnesium from 1.96% to 4.85%, markedly decreases the temperature required and thus aids the volume reaction kinetics with an incomparably more intense AlN formation. The experimental procedure used by Kudela et al employed heating provided by an autoclave induction furnace.

Hioki et al, U.S. Pat. No. 4,244,751, discloses an aluminum nitriding method which employs heating the aluminum in a mixture of inert gas and nitrogen using the heat of an electric arc, e.g., TIG (tungsten inert gas) torch. The surface of the workpiece is melted comprehensively and maintained in a molten state for several to 10 seconds and then is cooled gradually. The gas mixture contains a maximum nitrogen content of 50% by weight to maintain the generated arc in a stable state. A specific example employing an aluminum-magnesium alloy containing five percent magnesium is reported. Distortion of the workpiece is not addressed, i.e., distortion attributable to the heating and melting from the TIG torch used by Hioki et al.

Jones, U.S. Pat. No. 3,944,443, uses a plasma gas of propane and nitrogen for hardening steel surfaces. Aluminum is disclosed as one of various other metals which may also be employed in the method. However, the Jones method does not appear to involve any nitriding since the nitrogen mixture for the plasma gas is disclosed only as an option to the use of propane alone.

Articles appearing in the *J. Chem. Phys.* 75(4), 15 August 1981, by Taylor et al for "Reaction of $N_2^+$ Beams With Aluminum Surfaces" and in the *J. Appl. Phys.* 52(9), September 1981, by Lieske et al for "Formation of Al-Nitride Films at Room Temperature by Nitrogen Ion Implantation Into Aluminum" disclose methods involving nitrogen ion implantation into the surface of aluminum. Ion beams of nitrogen are produced and directed by an ion gun in a bombardment of the aluminum to form aluminum nitride films.

Lasers have been used in various metallurgical surface hardening processes.

Lorenzo et al, U.S. Pat. No. 4,313,771, discloses a laser treatment for hardening carbon steel. A surface pretreatment is disclosed involving coating or blackening the surface of the workpiece for the purpose of facilitating absorption of laser energy. Such coatings are formed using a solution of an alkali metal hydroxide, alkali metal nitrate, alkali metal nitrite, and optionally an alkali metal carbonate in water. The steel workpiece is immersed in a boiling aqueous solution containing the alkali metal salt at a temperature of from about 124° C. to about 165° C. to obtain a black coating. Phosphate coatings also are disclosed to be suitable.

Yen et al, U.S. Pat. No. 4,157,923, discloses a method for hardening aluminum by laser to incorporate deposits of an alloying agent for mixing with melted base metal. Alloying agents to be used in aluminum or aluminum alloys are disclosed to be copper, nickel, tungsten, molybdenum, zirconium, vanadium, magnesium, zinc, chromium, cobalt, and titanium.

*Applications of Lasers in Materials Processing,* American Society for Metals (1979), at p. 199 et seq., discloses laser treatment of aluminum to produce a refined grain structure and a more homogeneous composition. The ASM text discloses that a high reflectivity of aluminum alloys may be overcome by coating with an energy absorber formed by treatment with a 10% sodium hydroxide solution in water for about 10 minutes to develop an oxide-hydroxide coating.

A serious problem associated with prior art processes for producing aluminum nitride involves the comprehensive heating and melting of the aluminum workpiece to be nitrided. Such extensive heating and melting have been identified as important to the aluminum nitride formation. Such prior art processes for aluminum nitriding have involved long heating times, high temperatures, and high pressures of nitrogen atmosphere.

An object of the present invention is to provide aluminum nitriding and overcome problems associated with prior art processes in regard to the dimensional distortion of an aluminum workpiece attributable to a comprehensive heating and melting.

It is also an object of the present invention to provide aluminum nitriding in precisely localized areas of an aluminum workpiece.

A principal object of the present invention is to provide a novel formation of aluminum nitride by laser treatment of a compact aluminum workpiece over a very short time duration.

It is a further object of the present invention to increase the hardness and wear resistance of a compact aluminum workpiece.

SUMMARY OF THE INVENTION

The present invention includes a method for, and a workpiece formed by, nitriding a compact aluminum workpiece by providing a compact aluminum or aluminum alloy workpiece, maintaining an atmosphere rich in nitrogen in contact with the workpiece, and exposing a portion of the surface layer of the workpiece to a laser beam having sufficient power density for a very short time, e.g., less than one second, to form a hardened surface layer comprising aluminum nitride. A surface pretreatment step is used to form a smutty surface layer on the workpiece prior to exposing the workpiece to the laser, said smutty surface layer preferably having a low content of impurities, i.e., compounds other than those formed from the composition of the workpiece. The surface treating to provide a smutty surface layer preferably comprises contacting the aluminum or aluminum alloy workpiece surface with an aqueous solution of an alkali metal hydroxide.

The workpiece to be provided for nitriding in the present invention comprises essentially pure aluminum or an aluminum alloy preferably containing less than 2.1 weight percent magnesium. A preferred alloy includes aluminum alloy having at least 5 weight percent silicon. A preferred embodiment includes using an alloy which is essentially free of $Mg_2Si$.

An aluminum workpiece provided by the present invention can have a bandwidth or lateral dimension of hardness containing aluminum nitride in the range of 1 mil to about 1.0 inch or more, and can have a depth of nitride in the range of 1 mil to 50 mils for even a larger bandwidth, such as 1.0 inch bandwidth.

The atmosphere rich in nitrogen comprises 75 to 100 volume percent nitrogen and preferably comprises 95–100 volume percent nitrogen.

The present invention employs a laser interaction time which preferably can be less than 0.01 of a second.

DETAILED DESCRIPTION OF THE INVENTION

In accordance with the present invention, aluminum or aluminum alloy can be nitrided to form a surface layer of aluminum nitride by employing a laser treatment to provide the hardened surface layer comprising aluminum nitride.

Aluminum or aluminum alloys are prepared for laser melting by a surface pretreatment etching in a solution such as an aqueous alkali metal hydroxide solution for a sufficient time and at a sufficient temperature to produce a dark etch smut on the surface. Etched specimens can be rinsed in water and allowed to dry in air with the etch smut retained on the surface. The etch smutting step is a preferred element of the process for the purpose of achieving a satisfactory and uniform coupling of the laser beam with the aluminum alloy surfaces thereby to provide an enhanced absorptivity of energy into the aluminum. The etching step is superior to solvent cleaning or bright dipping since the reflectivity of the aluminum produced by such processes produces a non-uniform melting of the workpiece and can also damage the laser equipment. The etch smut from treatment by alkali metal hydroxide also is superior to an application of coatings or paint which introduces impurities, i.e., compounds other than those predominant or present in significant amounts in the aluminum or aluminum alloy being treated. A preferred smutting agent is aqueous sodium hydroxide. Such a solution of caustic soda etch smut treatment works well for aluminum alloys. However, a caustic soda etch for 99.99% aluminum, which has a higher infrared reflectance, is only marginally effective because such high purity aluminum does not develop sufficient etch smut to absorb the radiation efficiently.

It has been found that the formation of aluminum nitride can be successfully achieved by the method of the present invention using a laser treatment of compact aluminum or aluminum alloy in contact with an atmosphere rich in nitrogen. Aluminum nitrides are formed in significant amounts in high purity aluminum and in aluminum-silicon alloys. Workpieces of aluminum and particularly aluminum-silicon alloy on which aluminum nitride has been formed exhibit significantly increased hardness.

A particularly surprising finding involves the discovery relating to an absence of nitride formation in the laser treatment in accordance with the present invention of alloys having at least 2.1 weight percent magnesium. Further in regard to the presence of magnesium, it has been found that an alloy having $Mg_2Si$ present, typically incorporated as a dispersion-strengthening constituent, exhibits a decrease in hardness following the nitridation process of the present invention. A possible explanation, although not considered definitive, is that the $Mg_2Si$-containing alloy while typically considered a heat treatable alloy may be annealed by the rapid heating by laser and subsequent cooling.

The present invention provides a hardened aluminum workpiece having a finely defined region, area, or zone of hardness on the workpiece surface. This hardness region can be defined, i.e., localized or contained, within a bandwidth or lateral dimension which is much smaller or narrower than is possible with conventional techniques. Further, a much smaller depth of melting is achievable at larger bandwidths with the present invention over known nitriding techniques such as TIG torch melting. For example, the bandwidths achievable from aluminum nitriding by laser can be as small as 1 mil, the limitation for smaller bandwidths being the quality of the laser focusing equipment. Further, aluminum nitriding by laser in accordance with the present invention is capable of providing a finely defined region in depth of hardness, e.g., to a depth as small as 1.0 mil or such as a depth of nitride in the range of about 1.0 mil to 50.0 mils, and more particularly in the range of about 1.0 mil to 20.0 mils, at a bandwidth of 1.0 inch. The nitride depth dimension produced in accordance with the present invention is dependent on and can be controlled by adjustments to the laser power density and interaction time. Such a finely defined region of hardness achieved by laser treatment in accordance with the present invention can be employed to provide a finely localized hardness region as well as to avoid a distortion of the workpiece as occurs with conventional heating, melting, or fusing techniques.

Workpieces of aluminum subjected to the process of the present invention exhibit small dendrite arm spacing in the cast structure, indicating a rapid solidification of the laser melted zone on the workpiece.

A suitable laser to provide sufficient laser heating treatment can be a continuous wave carbon dioxide laser. However, other laser devices can be used, such as a laser employing a neodymium:yttrium aluminum garnet (Nd:YAG).

A laser beam is applied typically in a perpendicular manner to the aluminum or aluminum alloy surface. The laser beam focus size can be 5 mils diameter to 20 mils diameter. Power inputs typically range from about 0.5 to 5 kW, and laser interaction times can be from $1.0\times10^{-3}$ to $1.0\times10^{-6}$ seconds with power densities from about 0.1 MW/cm$^2$ ($0.1\times10^6$ W/cm$^2$) to about 100 MW/cm$^2$. Shorter interaction times require higher power densities.

The atmosphere rich in nitrogen employed in the process of the present invention contains 75–100 volume percent nitrogen. However, the preferred embodiment of the present invention utilizes relatively high purity nitrogen, i.e., 95–100 volume percent nitrogen. The use of air, although containing nitrogen in the preferred range, is not considered suitable in the method of the present invention by reason of an undesirable presence of oxygen which will react with the aluminum and alloying elements to produce an undesirable oxide.

Further advantages and aspects of the method of the present invention will become evident from an inspection of the following working example, although the invention is not intended to be limited by the specific or preferred embodiments employed in the described experimental procedure.

EXAMPLE

Test specimens of aluminum and aluminum alloys were prepared in the form of sheets having an area dimension of 7.5×7.5 centimeters. A specimen description including composition data is provided in Table I.

TABLE I

| Test Specimen | Workpiece Composition Composition (weight percent) Maximum, unless stated as a range | | | | | | | | | |
|---|---|---|---|---|---|---|---|---|---|---|
| | Si | Mg | Zn | Fe | Cu | Mn | Cr | Ti | Other | Al |
| 99.99% Al | | | | | | | | | 0.01 | 99.99 |
| 7075 | 0.40 | 2.1–2.9 | 5.1–6.1 | 0.50 | 1.2–2.0 | 0.30 | 0.18–0.28 | 0.20 | 0.15 | remainder |
| 5182 | 0.20 | 4.0–5.0 | 0.25 | 0.35 | 0.15 | 0.20–0.50 | 0.10 | 0.10 | 0.15 | remainder |
| 6951 | 0.20–0.50 | 0.40–0.8 | 0.20 | 0.8 | 0.15–0.40 | 0.10 | — | — | 0.15 | remainder |
| 4045 | 9.0–11.0 | 0.05 | 0.10 | 0.8 | 0.30 | 0.05 | — | 0.20 | 0.15 | remainder |
| Al—Si—Mg | 6.8–8.2 | 1.7–2.3 | 0.20 | 0.8 | 0.25 | 0.10 | — | — | 0.05 | remainder |

The specimens were pretreated for laser melting by etching in an aqueous 5 percent sodium hydroxide solution for 10 minutes at 60° C. to produce a dark etch smut on the surfaces. Etched specimens were then rinsed in water and allowed to dry in air with the etch smut retained on the surface. The caustic pretreatment produced a dark etch smut which worked well for laser treatment on the four alloys, but the 99.99% aluminum had a higher infrared reflectance and did not develop sufficient etch smut to absorb the laser radiation efficiently.

A SPECTRA PHYSICS 975 TM continuous wave, carbon dioxide laser (10.6 μm) was employed for the laser treatment. The flat test specimens of aluminum and aluminum alloy were mounted on a table capable of moving back and forth under the laser beam at speeds of from 6.4 to 25.4 cm/sec. The laser beam was positioned perpendicular to the specimen surfaces and the beam size was focused to 0.762×0.508 mm (20×30 mils), or 0.387 mm$^2$ (0.006 in$^2$) in area. Power inputs ranged from 1 to 2.5 kW. Interaction times varied from 0.01 to 0.0003 seconds, and the power densities ranged from 260,000 to 650,000 W/cm$^2$. The surfaces of the test specimens were laser melted either in argon as a control or in high purity nitrogen provided in a manner as a shield gas atmosphere. Gas flow rates were approximately 20 standard cubic feet per hour.

Auger Electron Spectroscopy (AES) was performed on the identified test specimens processed through the experimental procedure. Results are presented in Table II (Surface Composition), Table III (Composition at 15 Angstroms depth into the surface), and in Table IV (Composition at selected depths into the surface).

TABLE II

| Alloy | Surface Composition by Auger Electron Spectroscopy (AES) of Laser Melted Aluminum Alloys (Atomic Percent) | | | | | | | | | |
|---|---|---|---|---|---|---|---|---|---|---|
| | 99.99% Al | | 7075 | 5182 | | 6951 | | 4045 | Al—Si—Mg | |
| Atmosphere | Ar | $N_2$ | $N_2$ | Ar | $N_2$ | Ar | $N_2$ | Ar | Ar | $N_2$ |
| | Major Elements | | | | | | | | | |
| Al | 18.5 | 23.5 | 6.0 | 6.2 | 23.0 | 18.2 | 24.2 | 25.9 | 9.9 | 16.2 |
| Mg | 0.2 | 0.2 | 34.7 | 40.0 | 19.8 | 21.2 | 16.3 | 0.7 | 37.1 | 28.9 |
| O | 23.8 | 19.1 | 44.3 | 48.7 | 56.4 | 45.3 | 49.1 | 37.2 | 49.3 | 47.9 |
| C | 44.8 | 40.9 | 9.7 | 1.9 | 0.4 | 1.2 | 2.6 | 18.4 | 1.5 | 3.0 |
| Si | 7.0 | 0.6 | 0.4 | 0.6 | — | 3.0 | 2.3 | 2.8 | 1.1 | 1.6 |
| Cu | 1.1 | 1.0 | — | 1.5 | — | 5.0 | 0.7 | — | — | — |
| Zn | 1.1 | 0.4 | 4.5 | — | — | 1.4 | 0.4 | 6.5 | — | — |
| $N_2$ | 1.0 | 13.5 | 0.1 | 0.2 | 0.3 | 0.9 | 2.6 | 3.9 | 0.3 | 2.0 |
| | Impurity Elements | | | | | | | | | |
| Na | 1.2 | — | — | 0.2 | — | 0.2 | — | — | 0.6 | 0.1 |
| Fe | — | — | — | 0.4 | — | 1.1 | 0.8 | 0.8 | — | — |
| F | 0.1 | 0.1 | — | — | — | — | — | — | — | — |
| Mn | — | — | — | — | — | — | — | — | — | — |

TABLE II-continued

| Surface Composition by Auger Electron Spectroscopy (AES) of Laser Melted Aluminum Alloys (Atomic Percent) | | | | | | | | | | |
|---|---|---|---|---|---|---|---|---|---|---|
| Alloy | 99.99% Al | | 7075 | 5182 | | 6951 | | 4045 | Al—Si—Mg | |
| Atmosphere | Ar | $N_2$ | $N_2$ | Ar | $N_2$ | Ar | $N_2$ | Ar | Ar | $N_2$ |
| Ca | 0.1 | — | — | — | — | 0.3 | 0.5 | — | 0.1 | — |
| Cl | 0.6 | 0.4 | 0.1 | — | — | 0.1 | — | — | — | — |
| S | 0.6 | 0.2 | 0.1 | 0.3 | — | 1.9 | 0.4 | 3.3 | — | 0.2 |
| K | — | — | — | — | — | 0.1 | 0.1 | — | 0.1 | — |
| P | — | — | — | — | — | — | — | — | — | — |

TABLE III

| Composition by AES at 15 Å Below the Surface of Laser Melted Aluminum Alloys (Atomic Percent) | | | | | | | | |
|---|---|---|---|---|---|---|---|---|
| Alloy | 99.99% Al | | 7075 | 5182 | | 6951 | | Al—Si—Mg |
| Atmosphere | Ar | $N_2$ | $N_2$ | Ar | $N_2$ | Ar | $N_2$ | $N_2$ |
| | | | Major Elements | | | | | |
| Al | 23.1 | 32.8 | 4.6 | 6.8 | 22.4 | 19.4 | 23.8 | 19.8 |
| Mg | 0.3 | 0.1 | 34.8 | 38.9 | 21.2 | 20.7 | 14.4 | 21.4 |
| O | 37.0 | 25.2 | 45.1 | 50.9 | 54.4 | 47.4 | 50.3 | 44.8 |
| C | 29.9 | 16.1 | 5.0 | 0.5 | 1.2 | 2.1 | 3.0 | 1.8 |
| Si | 3.1 | 0.6 | 0.5 | 0.7 | 0 | 2.7 | 2.6 | 1.5 |
| Cu | 0.7 | 0.3 | — | 1.2 | — | 3.5 | 0.6 | — |
| Zn | 0.2 | — | 9.6 | — | — | 1.1 | 0.3 | — |
| $N_2$ | 1.3 | 24.4 | <0.1 | 0.2 | 0.7 | 0.5 | 3.3 | 10.6 |
| | | | Impurity Elements | | | | | |
| Na | 1.7 | — | — | <0.1 | — | 0.2 | — | — |
| Fe | 0.1 | — | — | 0.5 | — | 1.1 | 0.9 | — |
| F | — | — | <0.1 | — | — | — | — | — |
| Mn | — | — | — | — | — | — | — | — |
| Ca | 0.2 | — | — | — | — | 0.3 | 0.5 | — |
| Cl | 0.2 | — | — | — | — | <0.1 | — | — |
| S | 0.8 | <0.1 | 0.1 | 0.2 | — | 0.9 | <0.1 | — |
| K | 0.7 | 0.3 | — | — | — | <0.1 | 0.1 | — |
| P | — | — | — | — | — | — | — | — |

TABLE IV

| Composition by AES at Indicated Depths in Laser Melted Aluminum Alloys (Atomic Percent) | | | | | | | |
|---|---|---|---|---|---|---|---|
| | 99.99% Al | | 6951 | | 4045 | Al—Si—Mg | |
| Alloy | Ar | $N_2$ | Ar | $N_2$ | Ar | Ar | $N_2$ |
| Depth of Analysis | 300 Å | 675 Å | 3150 Å | 3150 Å | 112 Å | 2450 Å | 2450 Å |
| Al | 97.1 | 96.6 | 91.3 | 78.4 | 86.3 | 76.2 | 88.8 |
| Mg | — | — | 0.9 | 2.2 | — | 2.4 | 0.6 |
| O | 0.6 | 0.4 | 6.3 | 12.2 | 1.1 | 11.1 | 2.0 |
| C | 2.0 | 1.5 | 0.6 | 1.3 | 1.1 | 2.0 | 0.8 |
| Si | — | — | — | 1.0 | 10.3 | 7.1 | 5.4 |
| Cu | — | — | 0.2 | 0.5 | — | — | — |
| N | 0.2 | 1.5 | <0.1 | 3.2 | 0.2 | 0.5 | 2.0 |
| Fe | — | — | 0.4 | 0.8 | 1.0 | 0.4 | 0.3 |
| Mn | — | — | — | — | — | — | — |
| Ca | — | — | 0.2 | 0.2 | — | 0.2 | <0.1 |
| S | — | — | | 0.2 | — | — | — |
| | | Oxide Thickness Indicators | | | | | |
| Appearance of Metallic Al | 26 Å | 41 Å | 750 Å | 700 Å | 75 Å | 315 Å | 450 Å |

Aluminum nitride formation was achieved in the laser treated specimens of aluminum, aluminum-silicon-magnesium (Al—Si—Mg), and aluminum-magnesium silicide (Al—$Mg_2Si$). A surprising finding was the absence of any significant formation of nitride in Alloys 5182 (4.0–5.0 weight percent Mg) and 7075 (2.1–2.9 weight percent Mg and 5.1–6.1 weight percent Zn).

Hardness tests were performed on selected specimens. A Tukon microhardness measurement made on metallographically polished cross sections of the laser treated specimens provided a measurement of hardness changes. Readings were taken both on the laser melted zone and on the non-melted portion of tested specimens. Results are reported in Table V.

TABLE V

| (Tukon) Microhardness, Knoop Indentor (KHN), 50 g Load (Laser Speed = 25.4 cm/sec.) | | |
|---|---|---|
| Alloy | Condition | KHN |
| 5182 | Not melted | 76 |
| | Laser melted in Ar | 91.5 |
| | Laser melted in $N_2$ | 93 |
| 6951 | Not melted | 108 |
| | Laser melted in Ar | 79.5 |
| | Laser melted in $N_2$ | 83.5 |
| 4045 | Not melted | 101 |
| | Laser melted in Ar | 137 |
| Al—Si—Mg | Not melted | 49 |
| | Laser melted in Ar | 146 |

TABLE V-continued

| (Tukon) Microhardness, Knoop Indentor (KHN), 50 g Load (Laser Speed = 25.4 cm/sec.) | | |
|---|---|---|
| Alloy | Condition | KHN |
| | Laser melted in $N_2$ | 155 |

All workpieces of alloys which showed an uptake of aluminum nitride from the process of the present invention consistently showed a somewhat harder surface from laser treatment in nitrogen as compared to laser treatment in the control atmosphere of argon. The aluminum alloy comprising Al—Si—Mg having a composition of aluminum plus about 7.5% silicon plus about 2% magnesium after having been processed in the method of the present invention exhibited triple the microhardness of the original material. The aluminum alloy containing $Mg_2Si$, although a heat treatable alloy, exhibited a decrease in hardness when subjected to nitriding by laser treatment. However, the microhardness of the Al—$Mg_2Si$ alloy did not decrease as much with a laser treatment in nitrogen as compared to laser treatment in argon.

What is claimed is:

1. A method for nitriding a metal workpiece, comprising:

(a) providing a workpiece comprising compact aluminum or aluminum alloy containing less than about 2.1 weight percent magnesium;

(b) maintaining an atmosphere rich in nitrogen in contact with said workpiece; and (c) exposing a portion of the surface layer of said workpiece to a laser beam at a power density of at least $0.1\times10^6$ W/cm$^2$ for less than one second to form on said workpiece a hardened surface layer comprising aluminum nitride.

2. A hardened aluminum workpiece comprising a workpiece of aluminum or aluminum alloy containing less than about 2.1% magnesium by weight and a finely defined region of hardness containing nitride on the surface of said workpiece, wherein said finely defined region is formed by the nitriding method according to claim 1.

3. A method according to claim 1 further comprising surface treating said workpiece prior to said exposing to a laser beam to form a smutty surface layer having a low content of impurities.

4. Claim 3 or claim 2 wherein said workpiece consists of aluminum alloy containing silicon in an amount of at least about 5 weight percent.

5. Claim 4 wherein said alloy is essentially free of $Mg_2Si$.

6. Claim 5 wherein said atmosphere comprises 75–100 volume percent nitrogen.

7. Claim 6 wherein said atmosphere comprises 95–100 volume percent nitrogen.

8. Claim 7 wherein said surface treating comprises contacting said workpiece surface with an aqueous solution of an alkali metal hydroxide.

9. Claim 8 wherein said laser interaction time is less than 0.01 of a second.

10. The workpiece according to claim 2 wherein said finely defined region has a bandwidth in the range of 1 mil to about 1.0 inch.

11. The workpiece according to claim 10 wherein said finely defined region has a depth of nitride in the range of about 1 mil to about 50 mils.

* * * * *